US006854417B2

(12) United States Patent
Stephens

(10) Patent No.: US 6,854,417 B2
(45) Date of Patent: Feb. 15, 2005

(54) ADJUSTABLE BOOKMARK

(76) Inventor: Sylvia G. Stephens, Southside Assisted Living Facility, 1600-B Toomer St., Opelika, AL (US) 36801

( * ) Notice: Subject to any disclaimer, the term of this patent is extended or adjusted under 35 U.S.C. 154(b) by 79 days.

(21) Appl. No.: 10/281,320

(22) Filed: Oct. 28, 2002

(65) Prior Publication Data

US 2003/0084836 A1 May 8, 2003

Related U.S. Application Data

(60) Provisional application No. 60/331,093, filed on Nov. 8, 2001.

(51) Int. Cl.[7] ..... B42D 9/00

(52) U.S. Cl. ..... 116/238; 116/234

(58) Field of Search ..... 116/234, 235, 116/236, 237, 238, 239, 240; D19/34; 281/42; 283/36, 37, 38, 39, 40, 41, 42, 43

(56) References Cited

U.S. PATENT DOCUMENTS

| | | | | | |
|---|---|---|---|---|---|
| 1,346,856 | A | * | 7/1920 | Spague | 116/239 |
| 1,387,358 | A | * | 8/1921 | Costello | 24/115 G |
| 1,455,879 | A | | 5/1923 | Gronlund | |
| 1,809,943 | A | | 6/1931 | Ockenden | |
| D85,113 | S | | 9/1931 | Bergman | |
| 1,999,583 | A | | 4/1935 | Bouvier | |
| 2,330,538 | A | * | 9/1943 | Allen | 446/227 |
| 2,522,719 | A | * | 9/1950 | Johnson | 224/220 |
| 3,091,030 | A | * | 5/1963 | Zumbrunnen | 29/460 |
| 3,397,026 | A | | 8/1968 | Spina | |
| 3,708,862 | A | * | 1/1973 | Powell, Jr. | 29/433 |
| 3,898,951 | A | | 8/1975 | Clare | 116/239 |
| 4,041,892 | A | | 8/1977 | Nichols | 116/239 |
| 4,505,219 | A | | 3/1985 | Mangano | 116/234 |
| 4,507,830 | A | * | 4/1985 | Dahan | 24/527 |
| 5,022,342 | A | | 6/1991 | Davis | 116/236 |
| 5,095,846 | A | * | 3/1992 | Knight | 116/238 |
| 5,195,335 | A | * | 3/1993 | Hart | 63/3.2 |
| 5,386,710 | A | * | 2/1995 | Moore | 63/3 |
| 5,458,081 | A | | 10/1995 | Reichert | |
| 5,515,809 | A | | 5/1996 | Weinberg | |
| 5,590,546 | A | * | 1/1997 | Hector | 63/38 |
| 5,622,387 | A | | 4/1997 | Ordway | |
| D384,373 | S | | 9/1997 | Wong | |
| 5,675,988 | A | * | 10/1997 | Ignatowski | 63/38 |
| 5,884,333 | A | * | 3/1999 | Soliman | 2/145 |
| 5,918,906 | A | | 7/1999 | West | |
| 5,946,728 | A | * | 9/1999 | Tane | 2/171 |
| 6,205,947 | B1 | | 3/2001 | Drew | |
| 6,557,376 | B2 | * | 5/2003 | Pratt | 63/3 |
| 2002/0095952 | A1 | * | 7/2002 | Kelly | 63/3 |
| 2003/0230229 | A1 | * | 12/2003 | Monroe | 116/234 |

FOREIGN PATENT DOCUMENTS

| | | |
|---|---|---|
| CA | 1194516 | 10/1985 |
| DE | 3503925 | 8/1996 |
| GB | 2275018 | 8/1994 |

* cited by examiner

*Primary Examiner*—Christopher W. Fulton
*Assistant Examiner*—R. Alexander Smith
(74) *Attorney, Agent, or Firm*—Richard C. Litman

(57) ABSTRACT

A bookmark is adjustable to closely fit the height of a book, magazine, or the like in order to preclude inadvertent slipping or falling from the work. The present bookmark essentially comprises a strand of material having opposite first and second ends, with the ends passing through one or more adjuster beads from opposite directions to form a loop. The two strands thus "criss-cross" within the passage through the bead, with their frictional interference and bends around the sides of the bead(s) to pass laterally through the bead(s), providing a good frictional fit in order to hold the adjustment as desired. The loop is passed over one cover and group of pages in the book or work, with one side of the loop passing around the back of the spine and the opposite side of the loop passing between the pages of interest to mark the place.

20 Claims, 9 Drawing Sheets

ADJUSTABLE BOOKMARK

CROSS-REFERENCE TO RELATED APPLICATION

This application claims the benefit of U.S. Provisional Patent Application Ser. No. 60/331,093, filed Nov. 8, 2001.

BACKGROUND OF THE INVENTION

1. Field of the Invention

The present invention relates generally to place markers, bookmarks, and the like, and more specifically to a bookmark which is adjustable for the height of the book. The present bookmark is easily adjusted to fit precisely around the spine and between the desired pages of a book, magazine, or the like, by means of one or more beads which may be selectively positioned along the cords or lines which form the present bookmark.

2. Description of Related Art

One of life's minor annoyances is that of losing one's place in a book, magazine, or other reading material when the material is set aside. As a result, a number of different forms and methods of marking one's place in the work, have been used over the years. While some persons will "dog ear," i.e., fold a corner of the page of interest, this is frowned upon, especially in library and other borrowed books and magazines, as it damages the work.

Most people simply use a small sheet of paper or the like, which is slipped between the pages to indicate the location to which the reader wishes to return. In fact, many bookstores provide small cards with their own name and advertising printed thereon, as free handouts when making a book or magazine sale. While such simple bookmarks are certainly cost effective, they are not optimal, in that they are easily dislodged from their location in a book, and especially in a magazine with stapled binding, where the bound edges of the pages do not provide especially tight spacing therebetween to secure a bookmark inserted therebetween.

Other types of bookmarks have been developed which wrap around the spine and between the pages of the book or magazine and which provide somewhat greater security for the mark when it is placed in the work. However, most bookmarks of this type comprise a simple loop of string, cord, etc., which must have a sufficiently large span as to fit the largest practicable work with which it might be used. As a result, the span of the loop is so large that the device fits relatively loosely in most books, and is prone to falling from the work in many instances.

As a result, a few adjustable span bookmarks have been developed. These devices rely upon various principles, e. g., elastic bands (a simple rubber band is often used), paired cords with longitudinal slides, etc. While such devices are operable, they do not necessarily provide the required friction to provide the positive retention of the mark about books and magazines of various sizes, as desired.

Accordingly, a need will be seen for an adjustable bookmark comprising at least one cord or line pair or loop, having at least one adjuster disposed on at least one end thereof. The two (or more) strands of the pair or loop pass laterally through a passage(s) in one or more beads or the like, in opposite directions. Thus, a cord entering from the first end of the bead exits the opposite second end, and the cord entering the second end exits the first end. The friction of the cords against one another within the bead passage, as well as the turns the cords make upon entering and exiting the bead, result in a good frictional fit between bead and cords, which results in a bookmark which may be easily but positively secured to precisely fit the height of a book, magazine, or other work as desired. The adjustment principle employed by the present adjustable bookmark also lends itself to use with multiple cords or strands, multiple adjuster beads at both ends of the span of the device, and additional features as well.

A discussion of the related art of which the present inventor is aware, and its differences and distinctions from the present invention, is provided below.

U.S. Pat. No. 1,455,879 issued on May 22, 1923 to Olaf A. Gronlund, titled "Guard For writing Implements," describes a cord of low friction material (silk, etc.) with a pen and pencil at opposite ends thereof. A slide or sleeve is installed around the cords to produce a loop, which allows the device to be worn around the neck with the writing implements hanging in front. Gronlund teaches away from the present invention, as he specifically states that the device is to "produce a minimum of friction" about adjacent material, i.e., the apparel of the wearer. Also, it is clear from FIG. 1 of the Gronlund patent, that the sleeve surrounding the two cord elements has slipped as far downwardly as possible, being stopped from further movement only by the uppermost of the two writing implements at the ends of the cord. In contrast, the lateral passage of the strands or cords in opposite directions through the bead(s) of the present bookmark, provide a good frictional fit for the cords and bead(s), thereby precluding any inadvertent slippage of the device once it has been adjusted.

U.S. Pat. No. 1,809,943 issued on Jun. 16, 1931 to Pierce Ockenden, titled "Bookmarker," describes a device having an elastic span with clips at opposite ends thereof. One or more inelastic lines or cords extend from one of the clips on the elastic band. The elastic band is hooked over the outside of the spine of the book by means of the two clips, with the inelastic cord(s) passed between the pages of interest in the book. The only adjustment provided is by the elastic component, which secures only to the outside of the spine and does not encircle the spine and space between the pages, as does the present adjustable bookmark. The Ockenden device would not be suitable for use with magazines and other works having relatively thin and flexible spines, due to the wide clips and the tension of the elastic spine securing band. Ockenden does not provide any means for adjusting the span of the cords which pass between the pages, as provided by the present adjustable bookmark.

U.S. Pat. No. 1,999,583 issued on Apr. 30, 1935 to Josephine Bouvier, titled "Book Hanger And Marker," describes a device essentially comprising a single cord with a hanging loop at one end and a pair of washers spaced apart along its length. The upper washer position is adjusted by tying a knot in the cord, immediately above the desired position of the washer. The cord is placed between the pages of a book, and the loop used to hang the device with the book suspended between the washers on the cord. The adjustment of the span of the Bouvier device is relatively cumbersome, and cannot be performed while the device is installed on a book, whereas the present bookmark provides for adjustment while in place on a book, if so desired. No means is provided by Bouvier for surrounding the spine of the book, as is provided by the present adjustable bookmark.

U.S. Pat. No. 3,397,026 issued on Aug. 13, 1968 to Joseph Spina, titled "Adjustable Eyeglass Retaining Strap," describes a device having a loop on each end which loop over the ear bows of a pair of eyeglasses. A central adjustment loop is also provided, with an adjustment sleeve surrounding the two cords forming the central loop. The Spina device teaches away from the present adjustable bookmark invention due to the separate ends which must connect to the separate ear bows of a pair of eyeglasses, and cannot be used to surround a structure as does the closed loop of the present bookmark. Moreover, the operation of the adjuster is different from that of the present bookmark, with the Spina adjuster sliding longitudinally along the cords therein.

U.S. Pat. No. 3,898,951 issued on Aug. 12, 1975 to Geraldine M. Clare, titled "Bookmarks," describes an elastic device having a loop for fitting about the cover of a book, and an extension which is selectively passed between the pages of the book, wrapped around the cover, and the end removably secured to the loop surrounding the cover. Clare does not provide any means for adjustment of the span of her bookmark, due to the elastic material from which it is made. Moreover, the Clare bookmark is unsuitable for use with magazines and similar large format works which have large, very flexible covers, due to the compression of the material by the elastic cover band.

U.S. Pat. No. 4,041,892 issued on Aug. 16, 1977 to Mary V. Nichols, titled "Book Marker Employing Endless Elastic Band," describes another elastic band type device, more closely related to the bookmark of the Clare '951 U.S. Patent discussed immediately above than to the present adjustable bookmark invention. The same points of difference raised in the discussion of the bookmark of the Clare '951 U.S. Patent are seen to apply here, as well.

U.S. Pat. No. 4,505,219 issued on Mar. 19, 1985 to Mary G. Mangano, titled "Adjustable Bookmark For Paperback And Hard Cover Books," describes yet another device having a configuration much like that of the devices of the Clare '951 and Nichols '892 U.S. Patents discussed above, except that the Mangano mark is inelastic and adjusts about the book cover with a buckle. Other than the non-elastic material used by Mangano, the same points noted in the discussion of the Clare '951 mark are seen to apply here as well.

U.S. Pat. No. 5,022,342 issued on Jun. 11, 1991 to Alton B. Davis, titled "Bookmark Apparatus," describes a device having one or more strings which pass between the pages of a book. The strings are secured to a clip or other device for securing the apparatus to the spine of a book. Each of the strings includes a series of markers which may be selectively positioned along the strings, to indicate which of the two pages adjacent the marker are of interest, and/or to indicate the specific position(s) of a passage(s) of interest. The Davis bookmark does not include any means for adjusting for the height of a book nor for completely surrounding the spine and passing between adjacent pages, as provided by the present adjustable bookmark. Moreover, the Davis bookmark is not adaptable for use with magazines or other works having stapled or extremely narrow spines, due to the need to secure the device to the spine of the book.

U.S. Pat. No. 5,458,081 issued on Oct. 17, 1995 to Susan A. Reichert, titled "Adjustable Bookmark," describes a number of variations of a device having a pair of strings or the like, with the strings connected at one end and free at their opposite ends. Various adjustment means are provided, with one embodiment having a longitudinally disposed sleeve on the two strings. The strings both enter and exit the sleeve from the same sides, and do not move relative to one another during adjustment. In contrast, the lines or cords of the present bookmark enter the adjuster sleeve(s) opposite one another and move relative to one another during adjustment, to provide positive frictional fit.

U.S. Pat. No. 5,515,809 issued on May 14, 1996 to Ann M. Weinberg, titled "Adaptable Bookmark," describes a series of embodiments of a bookmark employing a removable adhesive (as used on Post-It Notes®) to secure the device to a book spine and to mark specific pages and/or lines. None of the embodiments secure about the spine and between adjacent pages of a work to surround the spine, as provided by the present bookmark, and no adjustment of the span of a book spine surrounding loop is provided by Weinberg.

U.S. Pat. No. 5,622,387 issued on Apr. 22, 1997 to Griffin Ordway, titled "Bookmark," describes a device having a flat plate or sheet portion which is inserted between the pages of a book, with an elastic band which extends around the closed covers of the book and connects with a portion of the bookmark which extends above the book. The Ordway device does not wrap around the spine of the book and extend between pages adjacent to the spine, as does the present adjustable bookmark. Moreover, no double strands or lines are provided by Ordway, with adjusting means disposed on the strands, as provided by the present adjustable bookmark.

U.S. Pat. No. 5,918,906 issued on Jul. 6, 1999 to Zetta L. West, titled "Custom Made See Through Vinyl Paperback Book Cover And Custom Made Sliding Pointer Book Mark," describes a laminated book mark with a sliding pointer installed thereon. The basic book mark is used conventionally as a relatively thin sheet between pages, with the pointer indicating a specific line on a page. No means for surrounding the spine of the book, nor for adjusting the span of such a spine surrounding bookmark, is disclosed by West.

U.S. Pat. No. 6,205,947 issued on Mar. 27, 2001 to Iris C. Drew, titled "Place Finder Bookmark," describes a device having a thin, flexible strip attached to a flat plate or sheet of material. The plate or sheet is sandwiched between random pages of the book, with the strip being folded over between the pages of interest. A slide is placed on the strip, with an indicator showing the specific line of interest on the page. The slide also has an adjustable indicator to point toward the left or right page. No means for wrapping the device around the spine of a book or magazine is provided by Drew, nor is any adjustment means disposed upon multiple strands of material provided.

U.S. Pat. No. D-85,183 issued on Sep. 22, 1931 to Ernest Bergman, titled "Bookmarker," illustrates a design apparently comprising a loop with a decorative component at one point and an intermediate component between the decoration and the opposite end of the elongate loop. The strands of the loop appear to pass longitudinally through the intermediate component. No suggestion is made of any adjustability of any of the components of the Bergman design.

U.S. Pat. No. D-384,373 issued on Sep. 30, 1997 to Myndilee Wong, titled "Ribboned Bookmark," illustrates a design comprising a pentagonal plate with a series of ribbons extending therefrom. There does not appear to be any means of wrapping any of the components about the spine of the book, nor of adjusting a loop to fit around the book spine, as provided by the present adjustable bookmark invention.

Canadian Patent Publication No. 1,194,516 published on Oct. 1, 1985 to Andre L. Zeisky, titled "Clip-On Bookmark," describes a bookmark having an elongated, generally U-shaped wire member which clips over the spine of a book. The portion of the wire between the pages includes a series of sheets of material (advertising, etc.) wrapped therearound and extending between the pages. The Zeisky bookmark does not wrap completely around the spine of the work, nor is any means provided to adjust for the height of the book, whereas the present adjustable bookmark provides such means.

German Patent Publication No. 3,503,925 published on Aug. 7, 1986 to Rudolf Kreye describes (according to the drawings and English abstract) a device directed more toward holding one's place in an open book, than a bookmark for a closed book. The device comprises a plate which is positioned randomly between pages, with a retaining bar spaced therefrom which extends across the corner of the open page. The device cannot wrap around the spine of the book or work, and no adjustment for the height of the book is provided.

Finally, British Patent Publication No. 2,275,018 published on Aug. 17, 1994 to Jon K. I. Arroyo, titled "Self-Adhesive Bookmark," describes a device having a flexible, elongate strip for inserting between pages, with an adhesive attachment for securing the anchored end of the strip to the book. No adjustment means is provided. The Arroyo bookmark thus more closely resembles the mark of the Weinberg '809 U.S. Patent, than it does the present mark.

None of the above inventions and patents, either singly or in combination, is seen to describe the instant invention as claimed.

SUMMARY OF THE INVENTION

The present invention comprises various embodiments of a bookmark which is selectively adjustable to fit closely about the spine and between the pages of interest in a book, magazine, or similar work. Essentially, the present adjustable bookmark comprises an elongate strand of material having opposite first and second ends, with the two ends passing through at least one bead from opposite sides of the bead. Thus, if the device is suspended from a central point along the loop, with equal lengths of cord between the bead and the suspension point, the passage through the bead will be horizontal, with one of the strands passing from the first end and out the second end of the bead, and the opposite strand passing from the second end and out the first end of the bead. The strands thus "criss-cross" within the passage through the bead, which provides frictional interference to hold the bead in position along the strands as desired for a proper fit about the spine and between the pages of the book or other work.

Numerous variations or embodiments of the above basic invention are provided for herein, including multiple beads at either or both ends of the loop; retaining beads or other components secured to the two free ends of the strand; multiple strands; round, flat, and/or other strand cross sectional shapes; elastic and non-elastic strands or cords; decorative components, e.g., additional beads strung in series along the strands, tasseled ends, etc.; beads having themes (sports balls, etc.); and alphanumeric beads which may be used to indicate a message.

The present adjustable bookmark is used by placing the loop over one side of the book, i.e., over one cover and the group of pages to one side of the particular page of interest, at the location which is to be marked. One side of the loop passes to the outside of the book, around the back of the spine, with the other side of the loop passing between the adjacent pages to mark the place or page of interest. The bead(s) are then drawn toward the book to adjust the size of the loop to fit closely about the book, thus ensuring that the present bookmark cannot inadvertently slip or fall from the book. Yet, the present bookmark is easily removed from the book as desired, when it is no longer required. In multiple strand versions, each strand may be used to mark a separate gap between pages, as desired.

Accordingly, it is a principal object of the invention to provide an adjustable bookmark comprising a loop which installs removably about the spine and between adjacent pages of a book, including at least one adjusting bead disposed upon the strands, with the strands passing through the bead in opposite directions to provide a good frictional fit for holding position on the book.

It is another object of the invention to provide such an adjustable bookmark wherein the stranded material forming the loop may comprise single or multiple strands of elastic or inelastic material having flat, round, or other cross sections as desired.

It is a further object of the invention to provide such an adjustable bookmark including a plurality of adjusting beads at at least one end, and alternatively both ends, of the strand loop.

Still another object of the invention is to provide such an adjustable bookmark including additional beads or sleeves disposed in series along the strands; additional retaining bead retaining means and gripping means at one or both ends; and alphanumeric and/or themed adjusting beads, as desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an adjustable bookmark, essentially comprising a closed loop of material having at least one adjuster bead or device strung thereon. The two strands forming the two sides of the loop pass through the bead(s) from opposite directions, crossing one another within the single passage through the bead. The resulting friction provides good security for the device when adjusted to fit a book.

Figure 1:
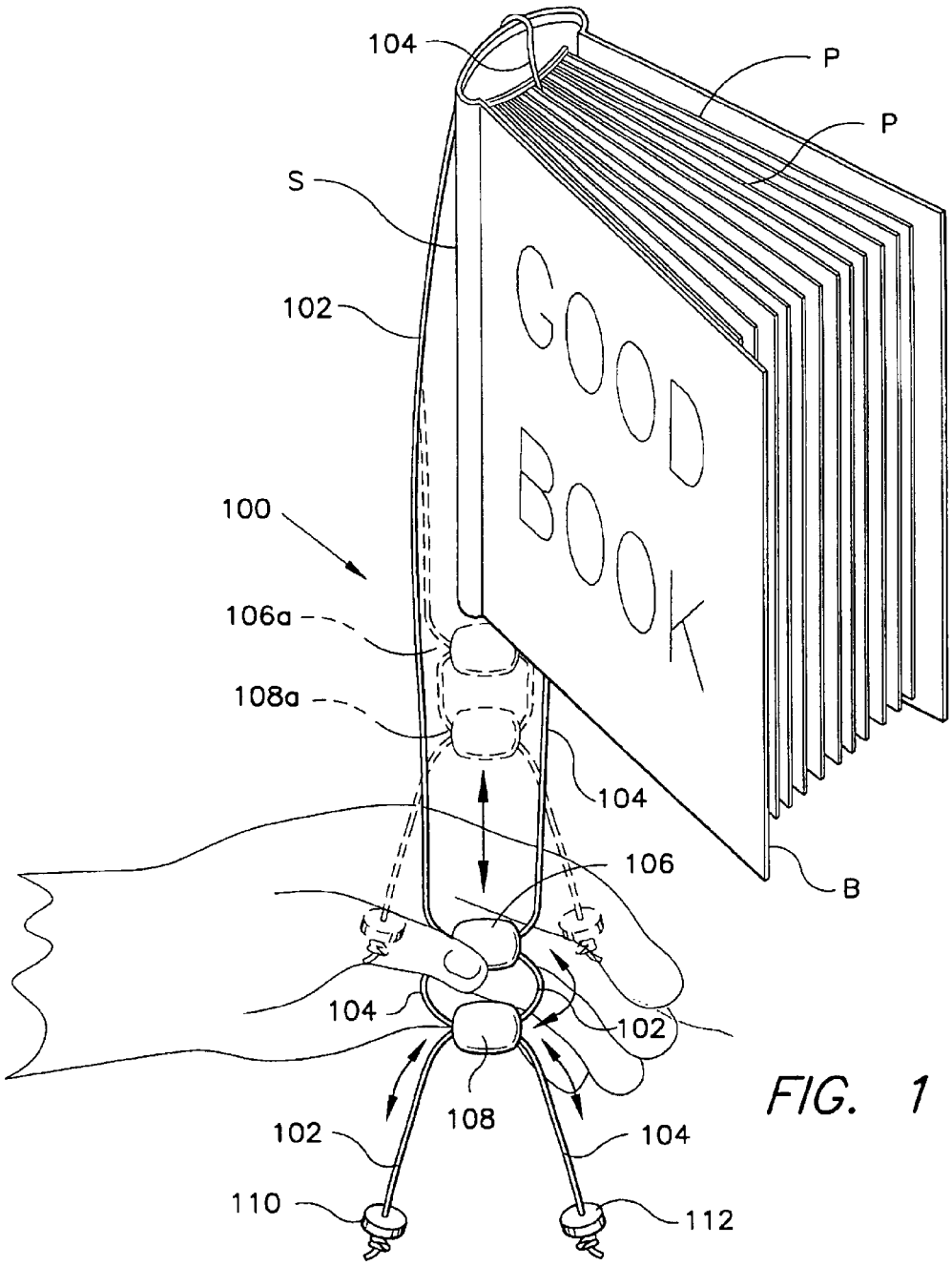
FIG. 1 is an environmental, perspective view of a basic first embodiment of the adjustable bookmark of the present invention, showing its operation and use.

FIG. 1 illustrates the structure and function of a basic first embodiment 100 of the present invention. The bookmark 100 comprises a closed loop of a single strand of thin, flexible material having opposite first and second portions, respectively 102 and 104, forming the opposite sides of the loop. The lower end of the loop in FIG. 1 is determined by a pair of adjuster beads, respectively 106 and 108. A stop or retainer, respectively 110 and 112, may be affixed to the end of each strand 102 and 104. The two portions 102 and 104 of the loop pass laterally (in the orientation shown in FIG. 1) through the single passage through each of the beads 16 and 18, crossing one another within each of the passages. Hence, the first strand 102 passes through the first bead 106 from left to right in FIG. 1, exiting the right side, and thence passes back through the second bead 108 from right to left, exiting from the left side. The second strand 104 passes through the beads 106 and 108 in directions opposite those of the first strand 102, i.e., from the right end to the left end of the first bead 106, and thence from left to right through the second bead 108.

This "criss-crossing" arrangement of the two strands 102 and 104 through each of the adjuster beads 106 and 108, provides a good frictional fit for the beads and results in their maintaining their selected positions along the cord strands 102 and 104. The present adjustable bookmark 100 (and other embodiments) is used by opening the book B to the selected pages P of interest, and passing one of the strands of the loop (e.g., the second strand 104) between the adjacent pages P and the opposite strand (e. g., the first strand 102) around the cover of the book B and in back of the spine S. The beads 106 and 108 are then manipulated upwardly along the two strands 102 and 104 to the positions 106*a* and 108*a* shown in broken lines in FIG. 1, to position the loop of the bookmark 100 securely about the spine S and between the pages P of the book B, precluding slippage of the bookmark 100 from between the pages of the book.

Figure 2:
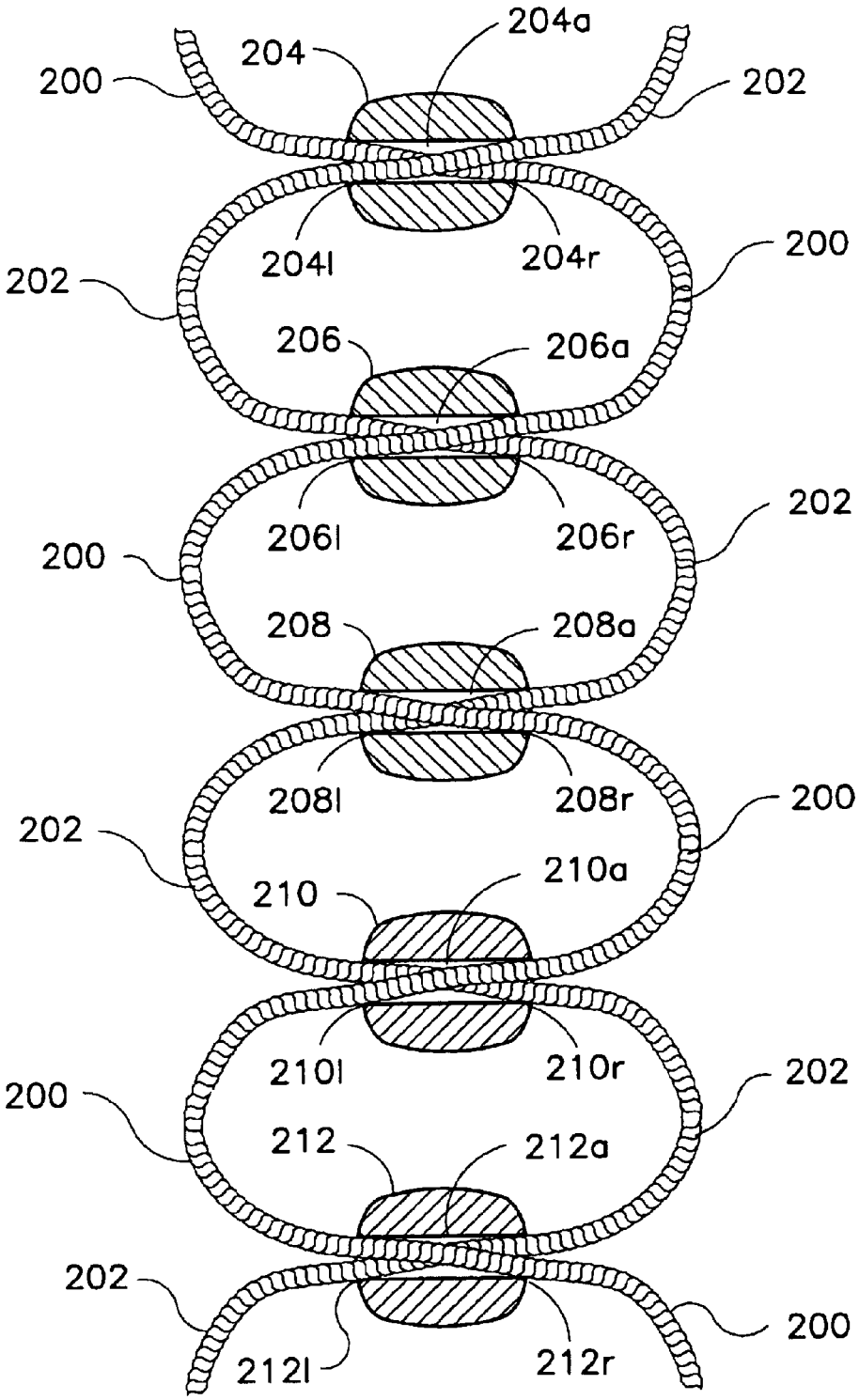
FIG. 2 is an elevation view in section of a series of adjuster beads strung on the cord or line of the present adjustable bookmark, showing the arrangement of the line through the beads.

FIG. 2 of the drawings more clearly illustrates the specific "criss-crossing" arrangement of the two strands through a series of beads. In FIG. 2, a first strand 200 and a second strand 202 are woven alternatingly back and forth through a group or series of adjuster beads, respectively 204 through 212. Each of the beads 204 through 212 includes a strand passage formed therethrough, with the strand passages being designated respectively as 204*a* through 212*a*. The passages have opposite first and second (or left and right, as shown in FIG. 2) ends, respectively designated as 204*l* through 212*l* for the first or left passage ends, and as 204*r* through 212*r* for the second or right passage ends. While a group of five beads 204 through 212 is illustrated in FIG. 2, it will be seen that as few as a single bead, two or more beads, or more than five beads, may be provided as desired, and that the beads may be distributed as one or two groups on one or both ends of the two strands forming the loop of the present adjustable bookmark. Preferably, at least two adjuster beads are provided at each adjustable end of the closed loop in each of the embodiments of the present adjustable bookmark, in order to provide more positive security for the adjustment of the bookmark as desired.

Figure 3:
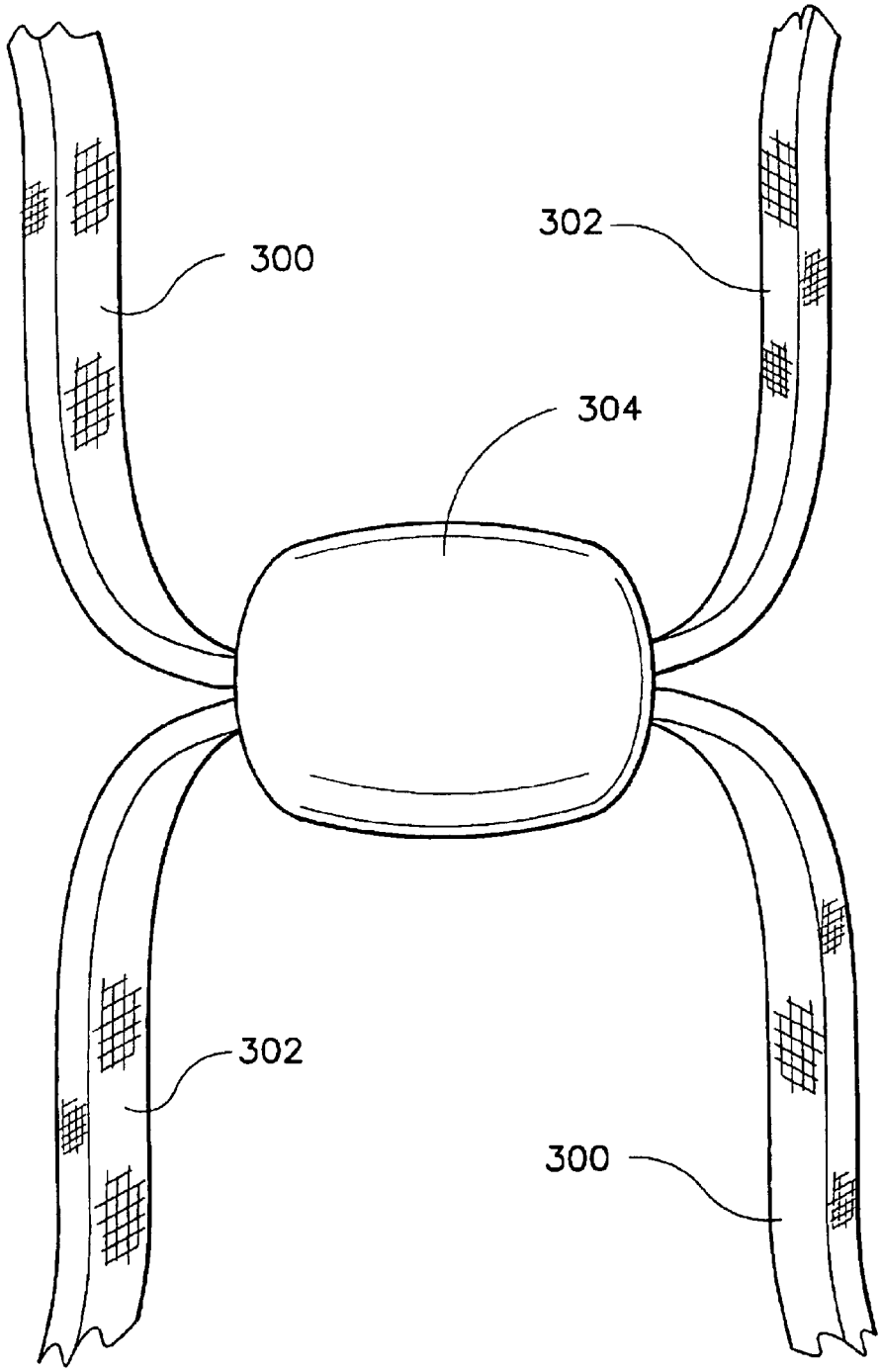
FIG. 3 is a detailed partial elevation view of an alternative embodiment of the present adjustable bookmark, employing a strand or line of material having a flat, ribbon configuration.

It will be seen that any practicable type of relatively thin and flexible cord, shoelace or other lacing material, etc. may be used to form the elongate strands of the present bookmark. To this point, the strands illustrated in FIGS. 1 and 2 have comprised cords, laces, or the like having round or circular cross sections. However, such rounded cross sections are not required for the present invention. In FIG. 3, a detailed partial elevation view is illustrated of an alternate embodiment having first and second strands 300 and 302 formed of a ribbon or lace material having a flat cross section and passing laterally through a bead 304 in opposite directions, as in the other embodiments of the present adjustable bookmark invention. The material from which the strands are formed may comprise any practicable material, including synthetic and natural fibers, woven and nonwoven leather and plastic, etc., as desired.

Figure 4:
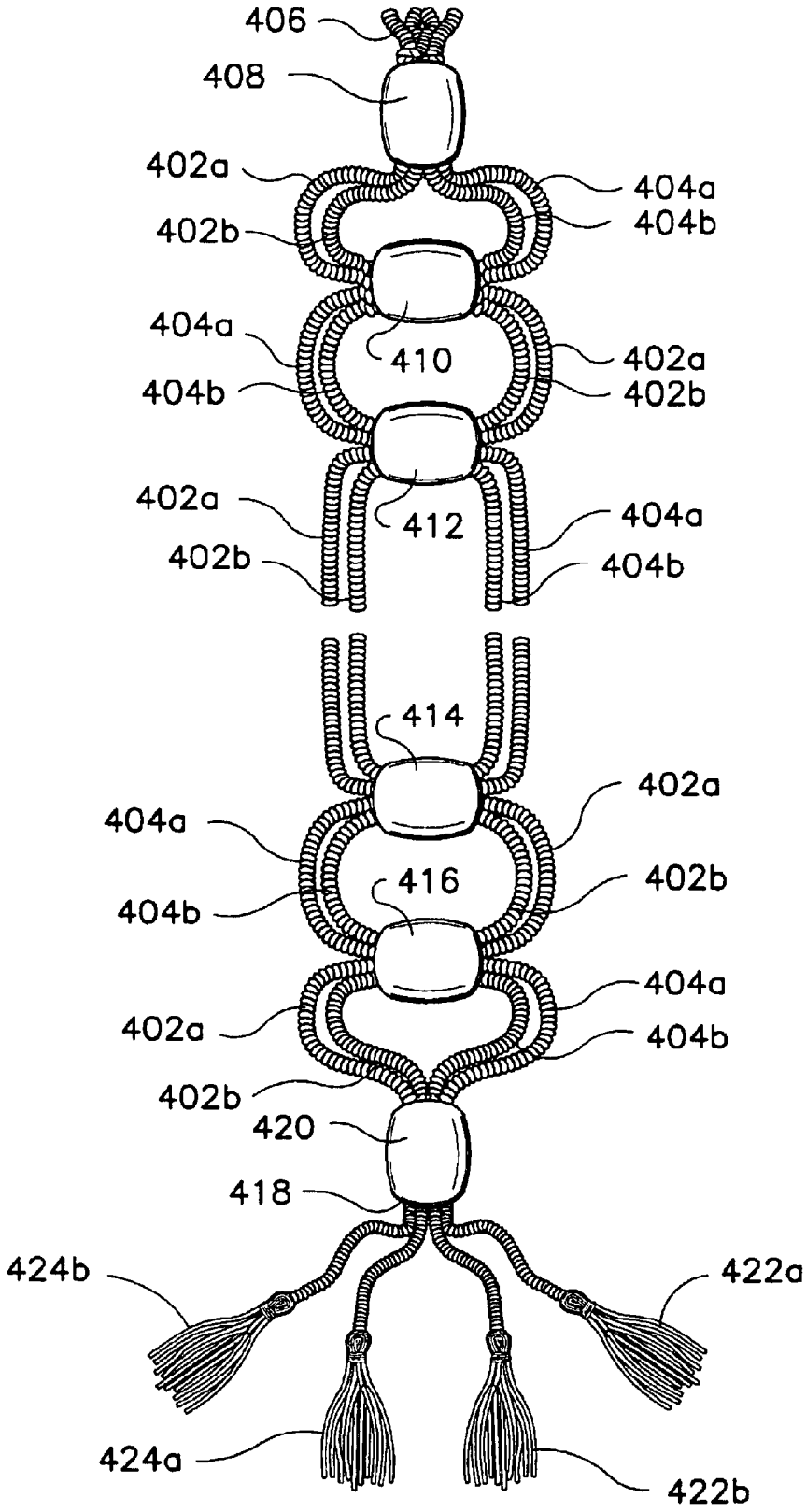
FIG. 4 is a partial elevation view of another alternative embodiment of the present adjustable bookmark, showing a plurality of adjuster beads and retaining means at each end.

FIG. 4 of the drawings illustrates yet another embodiment of the present adjustable bookmark, designated as bookmark 400. To this point, the loops of the various adjustable bookmark embodiments have been formed of a single length of material, or perhaps two portions of a single strand connected end to end. However, it will be seen that each of the strands comprising the two sides of the loop may actually comprise a plurality of thin, flexible lengths of material, depending upon their diameter or cross sectional dimensions and the diameter(s) of the adjuster bead passage(s) through which they must pass.

In FIG. 4, the first strand actually comprises two separate but parallel lengths of elongate cord or other material, designated as strands 402*a* and 402*b*. The opposite second strand is formed of two lengths of material 404*a* and 404*b*. The strands 402*a* through 404*b* are knotted or otherwise connected together at a first end 406 thereof, with an optional retainer bead 408 strung longitudinally along the first end portion 406 of the bookmark 400. The strands are separated to form the two strand groups comprising strands 402*a*, 402*b* and strands 404*a*, 404*b*, and pass through a first group of beads comprising a first bead 410 and an adjacent second bead 412. The strand groups 402*a*, 402*b* and 404*a*, 404*b* pass through each of the beads 410 and 412 in opposite directions to one another, in the manner illustrated in FIG. 2 and illustrated further above.

The bookmark 400 of FIG. 4 is shown as having an indefinite length, with a second group of adjuster beads comprising beads 414 and 416 positioned above the knotted or otherwise gathered second end 418 of the assembly. The strand groups pass laterally through these beads 414 and 416 in the same manner as that illustrated in FIG. 2 and used in the first group of beads comprising beads 410 and 412 of the bookmark 400. As with the first end portion 406, the second end portion 418 of the bookmark 400 may include an optional stop or retainer bead 420 strung longitudinally thereon, if so desired. Further bead retainer means comprising a series of tassels 422*a*, 422*b* and 424*a*, 424*b* extending respectively from the strands 402*a*, 402*b* and 404*a*, 404*b* may be provided in lieu of or in addition to the knotted end portion 418, if so desired.

Figure 5:
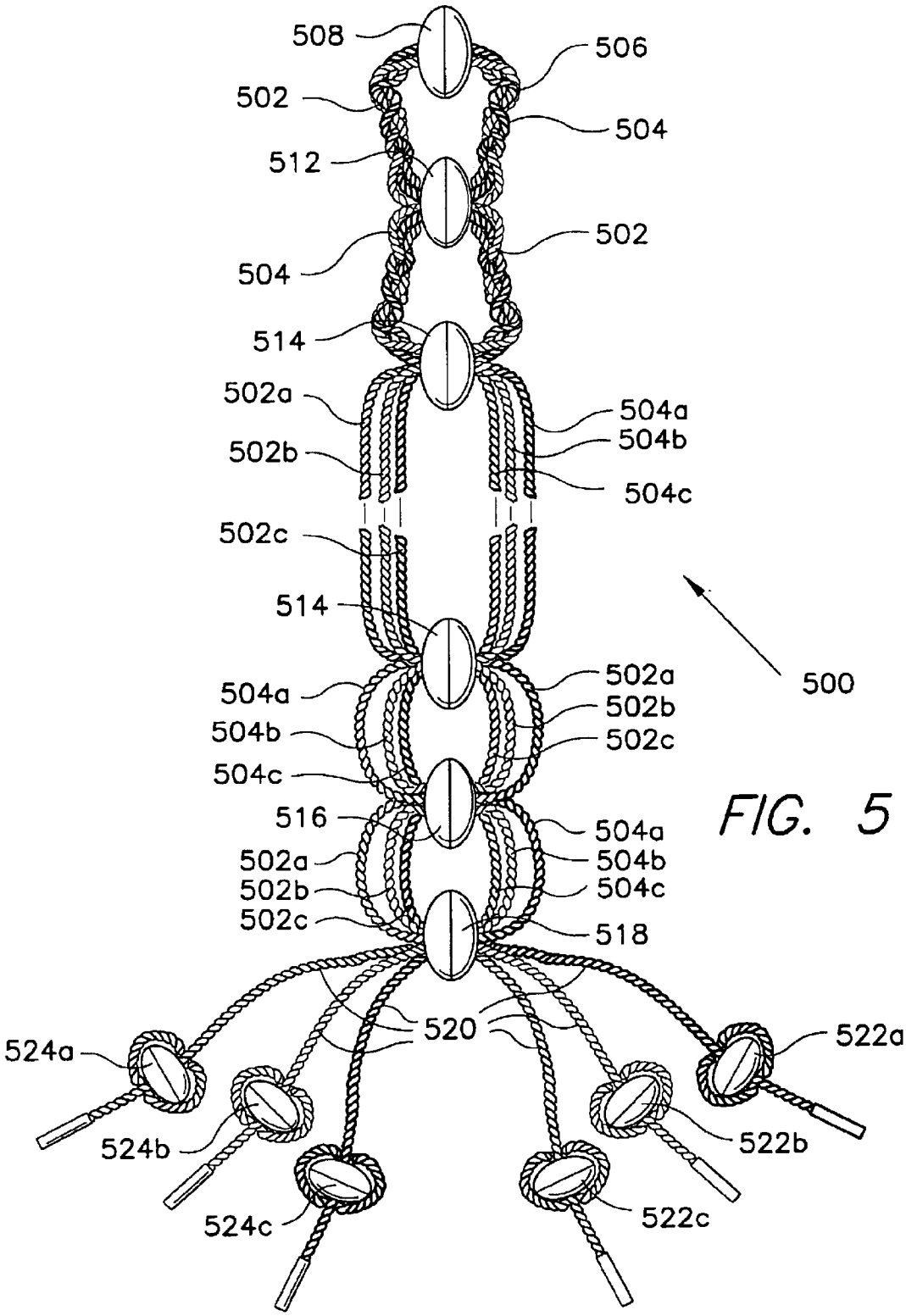
FIG. 5 is a partial elevation view of yet another alternative embodiment of the present adjustable bookmark having multiple strands or cords passing through the adjusters in each direction.

FIG. 5 illustrates a variation upon the embodiment of FIG. 4, with the adjustable bookmark 500 of FIG. 5 also using a series of elongate elements 502*a* through 502*c* and 504*a* through 504*c* to form each of the two strand portions 502 and 504. The bookmark 500 of FIG. 5 differs from the bookmark of FIG. 4 essentially in that it incorporates three elements to form each of the strand portions which comprise the loop of the bookmark, with the three elements of each strand group 502 and 504 being braided together at the first end portion 506 of the device. Each strand group 502 and 504 is braided separately from the other in order to pass in opposite directions through the beads 508 through 512 comprising a first adjuster bead group. The strands may comprise a series of three separate elements which are braided together along their central area to pass laterally through the first end adjuster bead 508 disposed generally centrally along the strands, as shown in FIG. 5.

A second group of adjuster beads comprising beads 514 through 518 is installed along the two strand groups adjacent the second end portion 520 thereof, generally in the manner used for the adjustable bookmark 400 of FIG. 4. The adjuster bead stop or retainer means used in the adjustable bookmark 500 embodiment of FIG. 5 differs from that of FIG. 4, in that each of the six strands 502*a* through 504*c* includes a separate retainer bead or element, respectively 522*a* through 522*c* for the first strand group and 524*a* through 524*c* for the second strand group. Each strand is threaded back through its respective retainer bead twice, to double around the bead to secure the bead in place on the respective strand.

Figure 6:
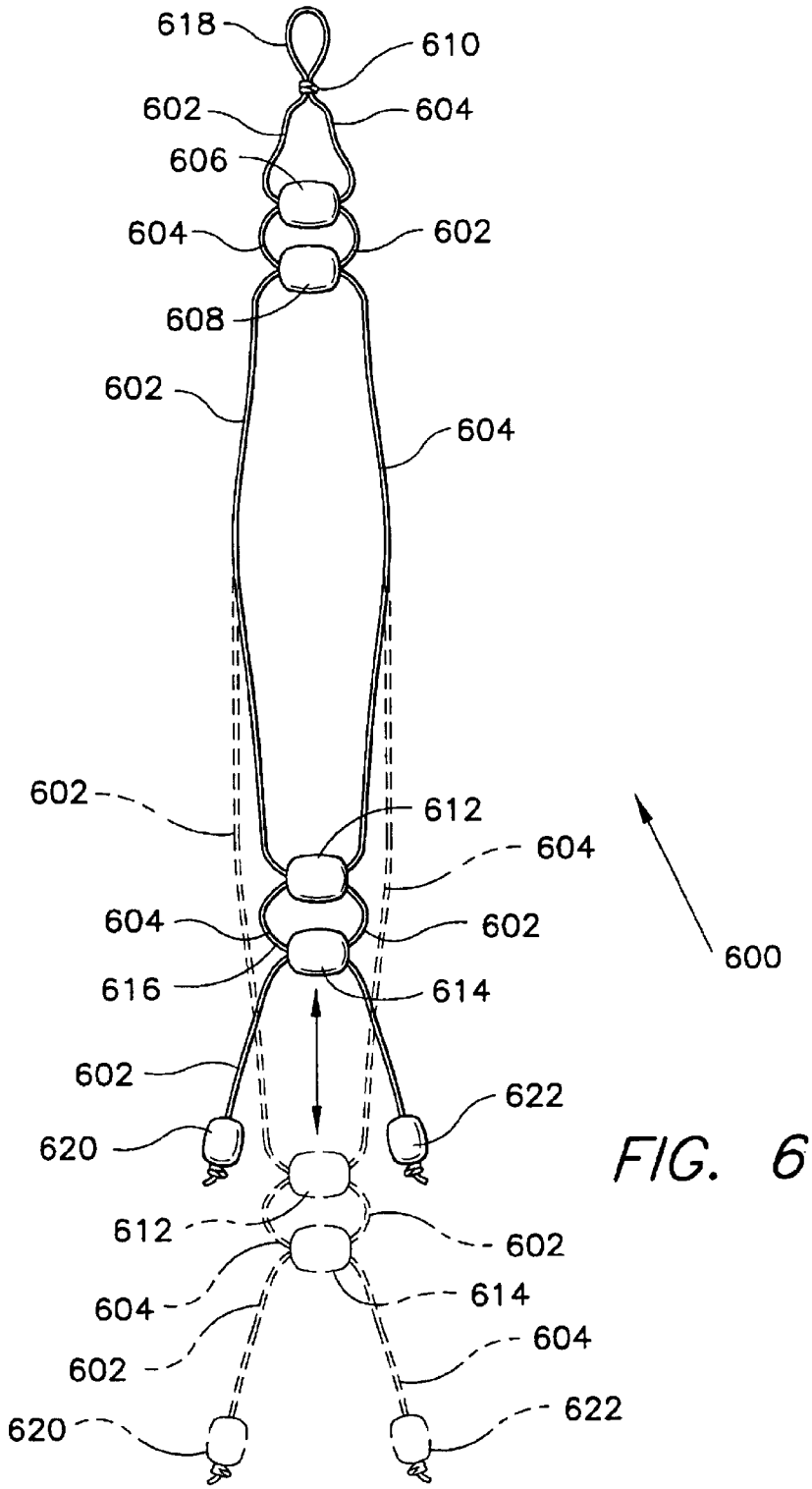
FIG. 6 is an elevation view of still another alternative embodiment, wherein the strands or cords are formed of an elastic material allowing the device to stretch to fit a book or work.

To this point, the strand elements have been indicated as being inelastic, i.e., they do not stretch appreciably when tension is applied thereto. However, the present adjustable bookmark may make use of elastic material for the elongate strands thereof, if so desired. FIG. 6 illustrates one embodiment of such an elastic adjustable bookmark 600. The bookmark 600 of FIG. 6 somewhat resembles the configuration of the bookmark 400 of FIG. 4, with the exception that the bookmark 600 of FIG. 6 uses only a single strand of elastic material. The strand comprises two portions, respectively 602 and 604, with a first group of adjuster beads comprising first and second beads 606 and 608 adjacent the first end 610 of the loop, and a second group of adjuster beads comprising beads 612 and 614 adjacent the opposite second end 616 of the loop. Rather than providing a separate retainer bead at the first end, a smaller knotted retainer loop 618 is formed in the first end 610 of the device. First and second retainer beads, respectively 620 and 622, are secured (e. g., knotted, etc.) to the distal ends of the two strand portions 602 and 604.

The adjustably positionable beads 606, 608 and 612, 614 allow the loop of the adjustable bookmark 600 of FIG. 6 to be adjusted in the same manner as that described further above for the embodiments of FIGS. 1 through 5. However, the elastic nature of the strand portions 602 and 604 permit the loop to be extended by stretching, generally as shown by the broken line portions of the strands 602 and 604, second end adjuster beads 612 and 614, and the second end retainer beads 620 and 622.

Figure 7:
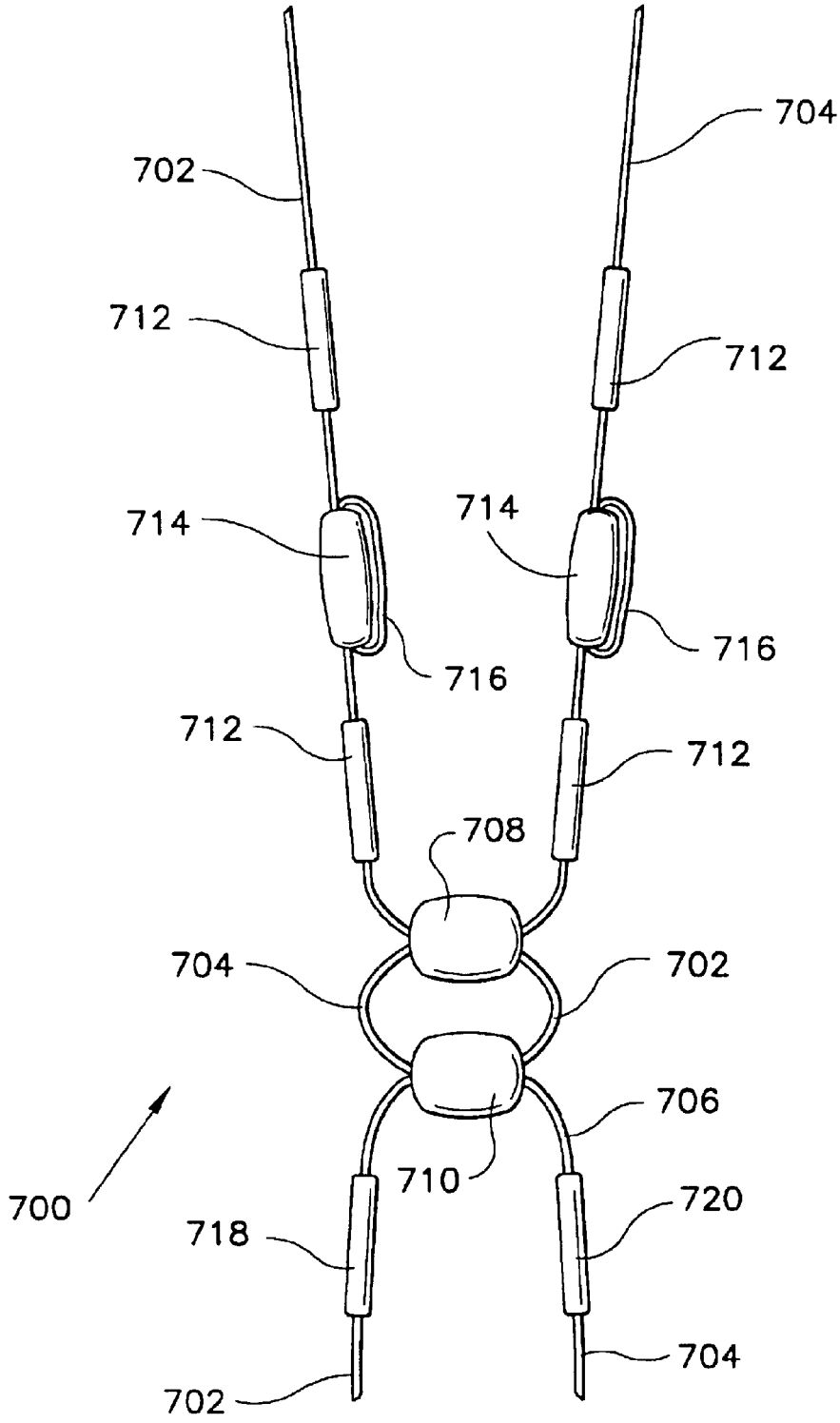
FIG. 7 is a partial elevation view of a further alternative embodiment of the present adjustable bookmark, having one or more additional beads strung in series along the strands or cords.

FIG. 7 of the drawings illustrates an embellishment to the present adjustable bookmark which may be applied to any of the various embodiments thereof, as desired. The bookmark 700 of FIG. 7 essentially comprises a pair of strands, respectively 702 and 704, as in the other embodiments of the present invention. These strands may be either single units, as in the embodiments of FIGS. 1, 2, 3, and 6, or may be multiple lengths of material, as in the embodiments of FIGS. 4 and 5. The strands 702 and 704 may be formed of either elastic or inelastic material, as desired.

The strands 702 and 704 form a loop. The first end portion of the loop is not shown in FIG. 7, but may comprise any one of the first end configurations of any of the embodiments of the present invention, as desired. The second end portion 706 includes a pair of adjuster beads, respectively 708 and 710, installed thereon. In addition, a number of trim beads 712 and 714 are installed in series along the lengths of the two strand portions 702 and 704. The first trim bead type 712 is relatively narrow with a small diameter passage therethrough, through which only a single strand thickness may be passed. The second type of trim bead 714 has a somewhat larger internal passage diameter, with the strands 702 and 704 being passed twice through the central passage of the larger beads 714 to form an external loop 716 therealong. Such trim beads may be used as stop or retainer beads at either end of the loop, e.g., the retainer beads 718 and 720 comprising two smaller diameter trim beads. These beads may be secured by knotting the strands 702 and 704 as in other embodiments shown in FIGS. 1 and 6.

Figure 8:
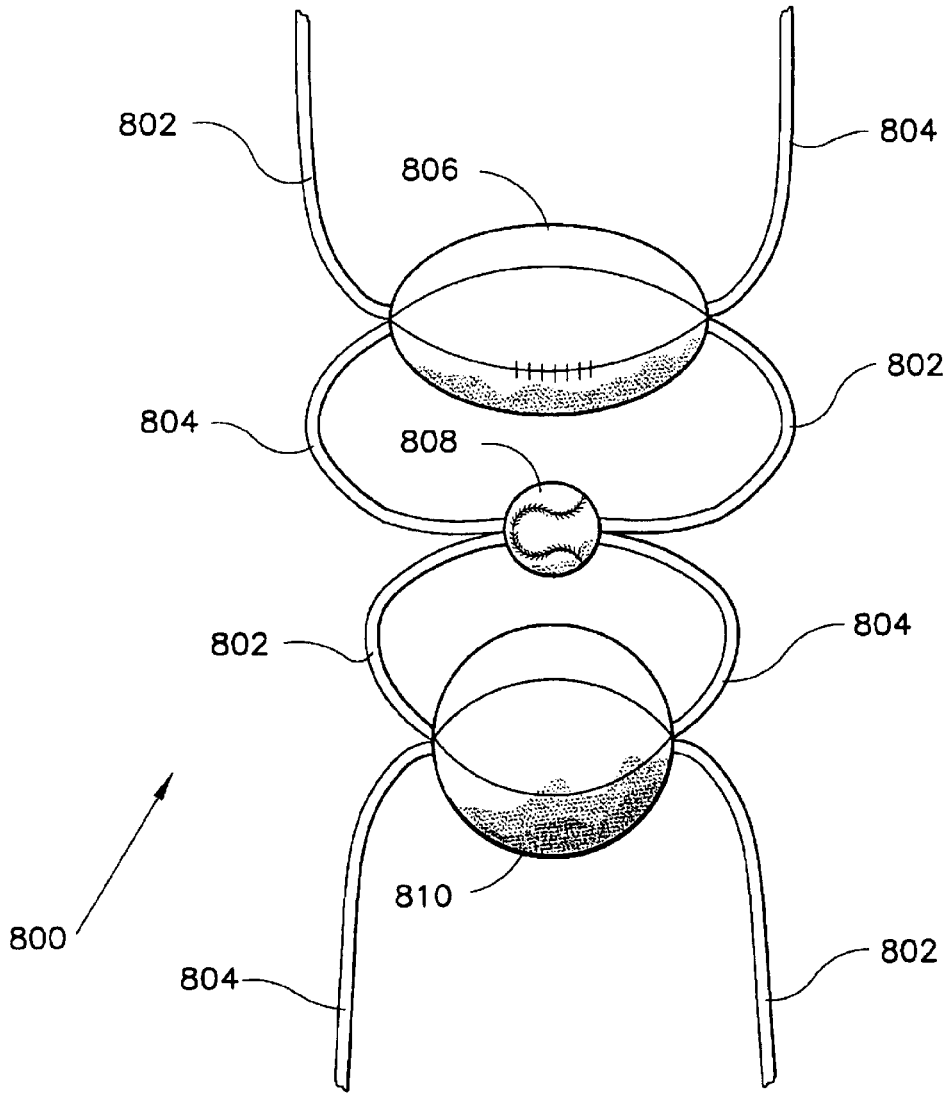
FIG. 8 is a detailed, partial elevation view of an additional embodiment of the present adjustable bookmark, wherein the adjuster beads each have a related theme.

FIG. 8 illustrates yet another variation upon the present adjustable bookmark invention, comprising bookmark 800. The bookmark 800 of FIG. 8 may incorporate single or multiple, elastic or inelastic lengths of material to form the two strands 802 and 804, as desired. The primary distinction of the bookmark 800 over other bookmark embodiments of the present invention, is the use of adjuster beads incorporating a mutually common theme, e.g., the sports ball theme of the three adjuster beads 806, 808, and 810 of the bookmark 800 of FIG. 8. While the three adjuster beads 806 through 810 of the bookmark 800 each represent a different type of sports ball, i.e., a football bead 806, baseball bead 808, and basketball bead 810, it will be seen that they may all be identically configured as the same type of ball, as desired. Moreover, other themes may be used, limited only by the configurations of the adjuster beads used with the present adjustable bookmark invention. Some exemplary themes are racing and other types of cars; flowers and other plants; animals; different geometric configurations; etc., as desired.

Figure 9:
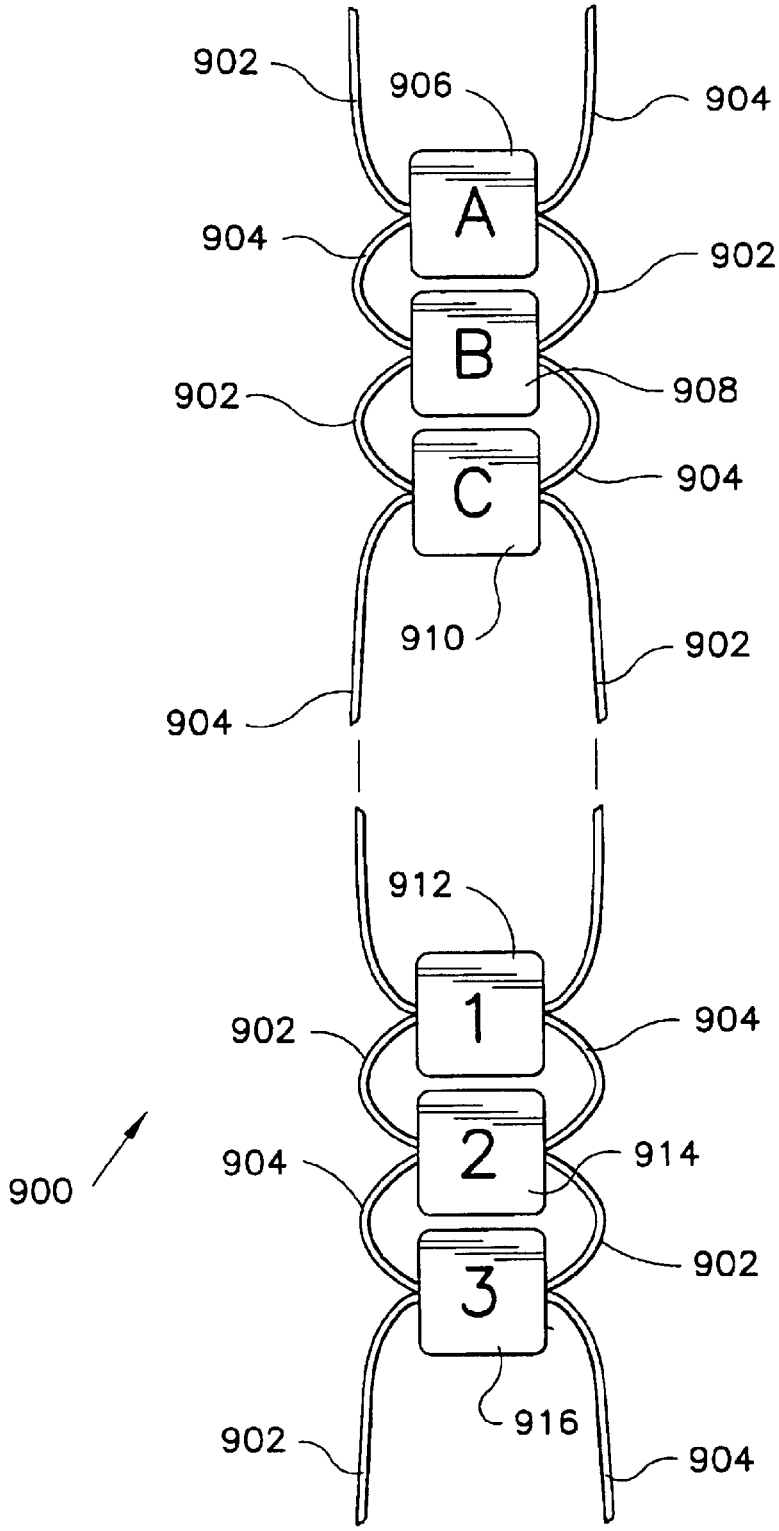
FIG. 9 is a partial elevation view of another alternative embodiment of the present adjustable bookmark, wherein the adjuster beads include alphanumeric indication means thereon.

FIG. 9 illustrates yet another embodiment of the present invention, wherein a series of alphanumeric beads are used. The adjustable bookmark 900 of FIG. 9 incorporates opposite first and second strands, respectively 902 and 904, to form a loop. The first and second ends of the loop are not illustrated in FIG. 9 in order to provide greater clarity for the illustrated features, but the loops will be understood to be of any one of the configurations previously disclosed to this point, or a related configuration.

The two strands 902 and 904 forming the partially shown loop of the adjustable bookmark 900 of FIG. 9 may be formed of any of the materials described herein, i.e., single or multiple lengths of elastic or inelastic materials, as desired. The primary distinction of the adjustable bookmark 900 of FIG. 9 is the use of adjuster beads having an alphanumeric theme. The three beads 906 through 910 of the first group of beads comprises a series of letters of the alphabet, while the three beads 912 through 916 of the second group comprise a series of numbers. It will be seen that more or fewer beads may be used in each group, with a greater number of beads providing greater latitude for spelling out words (names, etc.) or numbers (birthdates, etc.) if so desired. Also, by forming the adjuster beads with a number of discrete faces parallel to the respective passages formed therethrough, with each face having a different letter or number disposed thereon, the beads may be rotated about the strands 902 and 904 to change the word(s) and/or number(s) displayed, as desired.

In conclusion, the present adjustable bookmark provides a much needed means for positively securing a bookmark within a book, magazine, or other multiple page document, assuring that the bookmark cannot inadvertently slip or fall from the position in which it has been placed within the book. The present adjustable bookmark in any of its various embodiments is easily adjusted, by widening the loop to fit about the spine of a book or other document and working one or more of the adjuster beads along the strands of the loop to form a close fit about the book spine.

The adjusting means of the present adjustable bookmark is novel, in that one or more adjuster beads are disposed with their axial passages generally normal to the lengths of the strands of the bookmark when the device is extended. Each strand passes through each passage of each bead in a direction opposite to that of its counterpart strand, thus "criss-crossing" within each adjuster bead. This provides a certain amount of friction as the strands work against one another, and also due to the bending of the strands at the edges of the bead passages. The result is that the present adjustable bookmark provides a positive grip about the spine of a book when installed thereon and adjusted to fit closely therearound.

The various embodiments of the present bookmark may comprise single or multiple strand elements of elastic or inelastic material, as desired. The adjuster beads may be incorporated as a single bead at one end of a relatively simple configuration, or may include one or more adjuster beads at each end of the loop of the device. Additional embellishments may be provided as desired, such as additional beads in series along either or both of the strands, adjuster beads having different themes, and different retainer beads, ties, tassels, etc. The resulting adjustable bookmark embodiments provide a wide variety of different configurations which will prove attractive to a wide number of readers.

It is to be understood that the present invention is not limited to the embodiments described above, but encompasses any and all embodiments within the scope of the following claims.

I claim:

1. An adjustable bookmark, comprising:

at least one thin, flexible strand of material forming a closed loop, and having at least a first portion and a second portion opposite said first portion;

at least one group of adjuster beads having a number of said adjuster beads, wherein each of said adjuster beads has a first end, a second end opposite said first end, and a strand passage formed therethrough and extending from said first end to said second end of said adjuster bead;

said first portion of said at least one strand adjustably passing through said strand passage of at least one of said number of said adjuster beads from said first end thereof and outwardly from said second end thereof;

said second portion of said at least one strand adjustably passing through said strand passage of said at least one of said number of said adjuster beads from said second end thereof and outwardly from said first end thereof, with said first portion of said at least one strand and said second portion of said at least one strand adjustably crossing one another within said strand passage of said at least one of said number of said adjuster beads; and said first portion of said at least one strand, said second portion of said at least one strand, and said at least one of said number of said adjuster beads defining said closed loop for passing said first portion of said at least one strand around the back of the spine of a book and selectively passing said second portion of said at least one strand between adjacent pages of the book, for selectively marking a position within the book as desired and adjusting said closed loop to fit about the spine of the book.

2. The adjustable bookmark according to claim 1, wherein:

said first portion of said at least one strand adjustably passing through said strand passage of a first one of said at least one group of adjuster beads from said first end thereof and outwardly from said second end thereof, thence continuing through said strand passage of a second one of said at least one group of adjuster beads from said second end thereof and outwardly from said first end thereof, and alternately continuing in the same manner according to the number of said adjuster beads of said at least one group of adjuster beads; and said second portion of said at least one strand adjustably passing through said strand passage of the first one of said at least one group of adjuster beads from said second end thereof and outwardly from said first end thereof, thence continuing through said strand passage of the second one of said at least one group of adjuster beads from said first end thereof and outwardly from said second end thereof, and alternately continuing in the same manner according to the number of said adjuster beads of said at least one group of adjuster beads.

3. The adjustable bookmark according to claim 1, wherein:

said at least one strand comprises a first strand and a second strand forming said closed loop;

said at least one group of adjuster beads comprises a first group and a second group of said adjuster beads, said first group and said second group each having a number of said adjuster beads;

said first end portion of said first strand adjustably passing through said strand passage of a first one of said first group of adjuster beads from said first end thereof and outwardly from said second end thereof, thence continuing through said strand passage of a second one of said first group of adjuster beads from said second end thereof and outwardly from said first end thereof, and alternately continuing in the same manner according to the number of said adjuster beads of said first group of adjuster beads;

said first end portion of said second strand adjustably passing through said strand passage of the first one of said first group of adjuster beads from said second end thereof and outwardly from said first end thereof, thence continuing through said strand passage of the second one of said first group of adjuster beads from said first end thereof and outwardly from said second end thereof, and alternately continuing in the same manner according to the number of said adjuster beads of said first group of adjuster beads;

said second end portion of said first strand adjustably passing through said strand passage of a first one of said second group of adjuster beads from said first end thereof and outwardly from said second end thereof, thence continuing through said strand passage of a second one of said second group of adjuster beads from said second end thereof and outwardly from said first end thereof, and alternately continuing in the same manner according to the number of said adjuster beads of said second group of adjuster beads;

said second end portion of said second strand adjustably passing through said strand passage of the first one of said second group of adjuster beads from said second end thereof and outwardly from said first end thereof, thence continuing through said strand passage of the second one of said second group of adjuster beads from said first end thereof and outwardly from said second end thereof, and alternately continuing in the same manner according to the number of said adjuster beads of said second group of adjuster beads; and said first strand, said second strand, said first group of adjuster beads, and said second group of adjuster beads defining said closed loop.

4. The adjustable bookmark according to claim 1, wherein said at least one strand comprises a plurality of thin, flexible lengths of material.

5. The adjustable bookmark according to claim 1, wherein said at least one strand has a first end and a second end, the bookmark further including:

at least one retainer disposed upon each of the ends of said at least one strand, for precluding removal of said at least one adjuster bead from said at least one strand.

6. The adjustable bookmark according to claim 1, further including at least one trim bead disposed in series along said at least one strand.

7. The adjustable bookmark according to claim 1, wherein said at least one strand is formed of material selected from the group consisting of a cord having a generally circular cross section, a lace having a generally circular cross section, a ribbon having a flat cross section, a lace having a flat cross section, a cord, a ribbon, and a lace.

8. An adjustable bookmark, comprising:

a first strand and a second strand;

each said strand being formed of at least one thin, flexible length of material, and having at least a first end portion with a first end and a second end portion with a second end opposite said first end portion and said first end;

a first group and a second group of adjuster beads, each said group having a number of adjusting beads;

each of said adjuster beads having a first end, a second end opposite said first end, and a strand passage formed therethrough and extending from said first end to said second end thereof;

said first end portion of said first strand adjustably passing through said strand passage of a first one of said first group of adjuster beads from said first end thereof and outwardly from said second end thereof, thence continuing through said strand passage of a second one of said first group of adjuster beads from said second end thereof and outwardly from said first end thereof, and alternately continuing in the same manner according to the number of said adjuster beads of said first group of adjuster beads;

said first end portion of said second strand adjustably passing through said strand passage of the first one of said first group of adjuster beads from said second end thereof and outwardly from said first end thereof, thence continuing through said strand passage of the second one of said first group of adjuster beads from said first end thereof and outwardly from said second end thereof, and alternately continuing in the same manner according to the number of said adjuster beads of said first group of adjuster beads;

said second end portion of said first strand adjustably passing through said strand passage of a first one of said second group of adjuster beads from said first end thereof and outwardly from said second end thereof, thence continuing through said strand passage of a second one of said second group of adjuster beads from said second end thereof and outwardly from said first end thereof, and alternately continuing in the same manner according to the number of said adjuster beads of said second group of adjuster beads;

said second end portion of said second strand adjustably passing through said strand passage of the first one of said second group of adjuster beads from said second end thereof and outwardly from said first end thereof, thence continuing through said strand passage of the second one of said second group of adjuster beads from said first end thereof and outwardly from said second end thereof, and alternately continuing in the same manner according to the number of said adjuster beads of said second group of adjuster beads; and said first strand, said second strand, said first group of adjuster beads, and said second group of adjuster beads defining a closed loop for passing said first strand around the back of the spine of a book and selectively passing said second strand between adjacent pages of the book, for selectively marking a position within the book as desired and adjusting said closed loop to fit about the spine of the book.

9. The adjustable bookmark according to claim 8, wherein said at least one strand comprises a plurality of thin, flexible lengths of material.

10. The adjustable bookmark according to claim 8, further including at least one retainer disposed upon the first and second ends of said first and second strands for precluding removal of said adjuster beads from said first and second strands.

11. The adjustable bookmark according to claim 8, further including at least one trim bead disposed in series along said first and second strands.

12. The adjustable bookmark according to claim 8, wherein said at least one strand is formed of material selected from the group consisting of a cord having a generally circular cross section, a lace having a generally circular cross section, a ribbon having a flat cross section, a lace having a flat cross section, a cord, a ribbon, and a lace.

13. The adjustable bookmark according to claim 8, wherein each of said adjuster beads includes a mutually common theme.

14. An adjustable bookmark, comprising:

a plurality of thin, flexible strands of material forming a closed loop, and having at least a first portion and a second portion opposite said first portion;

at least one group of adjuster beads having a number of said adjuster beads, wherein each of said adjuster beads has a first end, a second end opposite said first end, and a strand passage formed therethrough and extending from said first end to said second end of said adjuster bead;

said first portion of said strands adjustably passing through said strand passage of at least one of said number of said adjuster beads from said first end thereof and outwardly from said second end thereof;

said second portion of said plurality of strands adjustably passing through said strand passage of said at least one of said number of said adjuster beads from said second end thereof and outwardly from said first end thereof, with said first portion of said plurality of strands and said second portion of said plurality of strands adjustably crossing one another within said strand passage of said at least one of said number of said adjuster beads; and said first portion of said plurality of strands, said second portion of said plurality of strands, and said at least one of said number of said adjuster beads defining said closed loop for passing said first portion of said plurality of strands around the back of the spine of a book and selectively passing said second portion of said plurality of strands between adjacent pages of the book, for selectively marking a position within the book as desired and adjusting said closed loop to fit about the spine of the book.

15. The adjustable bookmark according to claim 14, wherein:

said first portion of said plurality of strands adjustably passing through said strand passage of a first one of said at least one group of adjuster beads from said first end thereof and outwardly from said second end thereof, thence continuing through said strand passage of a second one of said at least one group of adjuster beads from said second end thereof and outwardly from said first end thereof, and alternately continuing in the same manner according to the number of said adjuster beads of said at least one group of adjuster beads; and said second portion of said plurality of strands adjustably passing through said strand passage of the first one of said at least one group of adjuster beads from said second end thereof and outwardly from said first end thereof, thence continuing through said strand passage of the second one of said at least one group of adjuster beads from said first end thereof and outwardly from said second end thereof, and alternately continuing in the same manner according to the number of said adjuster beads of said at least one group of adjuster beads.

16. The adjustable bookmark according to claim 14, wherein:

said plurality of thin, flexible strands of material comprises a first plurality of strands and a second plurality of strands;

said at least one group of adjuster beads comprises a first group and a second group of said adjuster beads;

said first portion of said first plurality of strands adjustably passing through said strand passage of a first one of said first group of adjuster beads from said first end thereof and outwardly from said second end thereof, thence continuing through said strand passage of a second one of said first group of adjuster beads from said second end thereof and outwardly from said first end thereof, and alternately continuing in the same manner according to the number of said adjuster beads of said first group of adjuster bead said first portion of said second plurality of strands adjustably passing through said strand passage of the first one of said first group of adjuster beads from said second end thereof and outwardly from said first end thereof, thence continuing through said strand passage of the second one of said first group of adjuster beads from said first end thereof and outwardly from said second end thereof, and alternately continuing in the same manner according to the number of said adjuster beads of said first group of adjuster beads;

said second portion of said first plurality of strands adjustably passing through said strand passage of a first one of said second group of adjuster beads from said first end thereof and outwardly from said second end thereof, thence continuing through said strand passage of a second one of said second group of adjuster beads from said second end thereof and outwardly from said first end thereof, and alternately continuing in the same manner according to the number of said adjuster beads of said second group of adjuster beads; and said second portion of said second plurality of strands adjustably passing through said strand passage of the first one of said second group of adjuster beads from said second end thereof and outwardly from said first end thereof, thence continuing through said strand passage of the second one of said second group of adjuster beads from said first end thereof and outwardly from said second end thereof, and alternately continuing in the same manner according to the number of said adjuster beads of said second group of adjuster beads.

17. The adjustable bookmark according to claim 14, wherein each said strand has a first end and a second end, the bookmark further comprising at least one retainer disposed upon each said end of each said strand for precluding removal of said at least one adjuster bead from said plurality of strands.

18. The adjustable bookmark according to claim 14, further including at least one trim bead disposed in series along each said strand.

19. The adjustable bookmark according to claim 14, wherein said plurality of strands is formed of material selected from the group consisting of a cord having a generally circular cross section, a lace having a generally circular cross section, a ribbon having a flat cross section, a lace having a flat cross section, a cord, a ribbon, and a lace.

20. The adjustable bookmark according to claim 14, wherein:

said plurality of thin, flexible strands of material comprises a first plurality of strands and a second plurality of strands; and at least one said portion of at least one said plurality of strands is at least partially braided.

* * * * *